US008915198B2

(12) United States Patent
Massimini

(10) Patent No.: US 8,915,198 B2
(45) Date of Patent: Dec. 23, 2014

(54) TABLE SYSTEM

(71) Applicant: Sushi Nozawa, LLC, Santa Monica, CA (US)

(72) Inventor: Emanuele Massimini, Marina del Rey, CA (US)

(73) Assignee: Sushi Nozawa, LLC, Santa Monica, CA (US)

( * ) Notice: Subject to any disclaimer, the term of this patent is extended or adjusted under 35 U.S.C. 154(b) by 86 days.

(21) Appl. No.: 13/893,208

(22) Filed: May 13, 2013

(65) Prior Publication Data

US 2014/0331903 A1 Nov. 13, 2014

(51) Int. Cl.
*A47B 1/04* (2006.01)
*A47B 13/08* (2006.01)

(52) U.S. Cl.
CPC ..... *A47B 13/088* (2013.01); *A47B 1/04* (2013.01)
USPC ..... 108/78; 108/64; 108/69

(58) Field of Classification Search
CPC ..... A47B 1/04; A47B 1/08; A47B 3/083; A47B 2003/0835; A47B 21/03
USPC ..... 108/77, 78, 64, 65, 69
See application file for complete search history.

(56) References Cited

U.S. PATENT DOCUMENTS

| | | | | | |
|---|---|---|---|---|---|
| 1,490,261 | A | * | 4/1924 | Freeman | 108/66 |
| 1,571,806 | A | * | 2/1926 | Schmitt | 108/66 |
| 1,969,190 | A | * | 8/1934 | Mowrey et al. | 108/77 |
| 2,452,979 | A | * | 11/1948 | Zuckerman | 108/66 |
| 2,907,616 | A | * | 10/1959 | Sullivan | 108/66 |
| 3,185,114 | A | * | 5/1965 | Consin | 108/65 |
| 3,224,391 | A | * | 12/1965 | Cooper | 108/140 |
| 3,494,307 | A | * | 2/1970 | Kagan | 108/69 |
| 3,915,100 | A | * | 10/1975 | Sullivan | 108/64 |
| 4,130,070 | A | * | 12/1978 | Herrin | 108/143 |
| 5,082,038 | A | * | 1/1992 | Teel | 144/286.5 |
| 5,144,888 | A | * | 9/1992 | Heine et al. | 108/64 |
| 5,513,578 | A | * | 5/1996 | Tordsen | 108/77 |
| 5,560,302 | A | * | 10/1996 | Diffrient et al. | 108/64 |
| 5,622,118 | A | * | 4/1997 | Rowan | 108/65 |
| 5,709,157 | A | * | 1/1998 | Hanusiak | 108/78 |
| 6,032,588 | A | * | 3/2000 | Williamson et al. | 108/66 |
| 6,041,722 | A | * | 3/2000 | Baker | 108/77 |
| 6,324,997 | B1 | * | 12/2001 | Baker | 108/64 |
| 6,568,308 | B2 | * | 5/2003 | Ricker | 83/477.2 |
| 8,096,244 | B1 | * | 1/2012 | Bockheim et al. | 108/64 |
| 2002/0170470 | A1 | * | 11/2002 | Cheng | 108/69 |
| 2004/0035333 | A1 | * | 2/2004 | Lucatello | 108/65 |
| 2004/0069191 | A1 | * | 4/2004 | D'Urbino et al. | 108/77 |
| 2007/0107640 | A1 | * | 5/2007 | Lucatello | 108/77 |

* cited by examiner

*Primary Examiner* — Hanh V Tran
(74) *Attorney, Agent, or Firm* — Brennan C. Swain, Esq.; Jeffer Mangels; Butler & Mitchell LLP

(57) ABSTRACT

A table system that includes at least first and second table assemblies. The first table assembly includes a horizontally oriented first table member having a first upright member extending downwardly therefrom and a top surface and a bottom surface, a first flap member hingedly connected to the first table member and movable between a stowed position and a deployed position. The first flap member has a top surface and a bottom surface. The second table assembly includes a horizontally oriented second table member having a first upright member extending downwardly therefrom and a top surface and a bottom surface. A first top surface horizontal distance is defined between the top surfaces of the first and second table members. The top surface of the first flap member defines a first top surface width dimension. The first top surface horizontal distance and the first top surface width dimension are approximately the same.

11 Claims, 6 Drawing Sheets

TABLE SYSTEM

FIELD OF THE INVENTION

To present invention relates generally to a table system and, more particularly, to a table system positioned in a restaurant for maximizing seating potential.

BACKGROUND OF THE INVENTION

It is well known within the restaurant industry that more seating generally equates to more money. A need exists for the ability to maximize the available seating within a confined space. In many restaurants, tables for two (also known as two tops) are often moved together to accommodate parties of three or more. This can be time consuming and inefficient. These tables can only accommodate a certain number of patrons within the floor space allotted for the tables. For example, three two tops positioned near one another (see FIG. 4) can only accommodate six patrons. It would be advantageous to use the same amount of floor space to accommodate more than six patrons even though the tables are fixed to the floor. The present invention addresses such a need.

SUMMARY OF THE PREFERRED EMBODIMENTS

In accordance with a first aspect of the present invention there is provided a table system that is adapted to be affixed to a floor and includes at least first and second table assemblies. The first table assembly includes a horizontally oriented first table member having at least a first upright member extending downwardly therefrom and a top surface and a bottom surface, a first flap member hingedly connected to the first table member and movable between a stowed position and a deployed position. The first flap member has a top surface and a bottom surface. The second table assembly includes a horizontally oriented second table member having at least a first upright member extending downwardly therefrom and a top surface and a bottom surface. A first top surface horizontal distance is defined between the top surface of the first table member and the top surface of the second table member. The top surface of the first flap member defines a first top surface width dimension. The first top surface horizontal distance and the first top surface width dimension are approximately the same. In the deployed position, the first flap member spans the first top surface horizontal distance such that the top surface of the first table member, first flap member and second table member form a generally continuous surface.

In a preferred embodiment, a first bottom surface horizontal distance is defined between the bottom surface of the first table member and the bottom surface of the second table member. The bottom surface of the first flap member defines a first bottom surface width dimension. The first bottom surface horizontal distance and the first bottom surface width dimension are approximately the same. The first bottom surface width dimension is greater than the first top surface width dimension, and the first bottom surface horizontal distance is greater than the first top surface horizontal distance. Preferably, the second table assembly includes a second flap member hingedly connected to the second table member and movable between a stowed position and a deployed position. The second flap member has a top surface and a bottom surface. The top surface of the second flap member defines a second top surface width dimension, and the first top surface width dimension and the second top surface width dimension are approximately the same.

In a preferred embodiment, the second table member includes at least one movable positioning member affixed to the bottom surface thereof that is movable between a stowed position and a deployed position. In the deployed position, the positioning member maintains the first flap member in its deployed position. Preferably, the first table assembly includes a flap securing assembly that maintains the first flap member in the stowed position.

In accordance with another aspect of the present invention there is provided a method performed in a restaurant having a floor that includes providing a first table assembly that includes a horizontally oriented first table member having at least a first upright member extending downwardly therefrom that is secured to the floor, and first and second opposing side surfaces, third and fourth opposing side surfaces, a top surface and a bottom surface, and a first flap member hingedly connected to the first table member. The first flap member has an abutting end surface, a hinge side surface, a top surface and a bottom surface. The first flap member is in a stowed position such that the bottom surface of the first flap member is adjacent the bottom surface of the first table member. The method also includes providing a second table assembly that includes a horizontally oriented second table member having at least a second upright member extending downwardly therefrom that is secured to the floor, and a top surface and a bottom surface. The method also includes pivoting the first flap member from the stowed position to a deployed position such that the abutting end surface of the first flap member abuts the second side surface of the second table member, so that the top surfaces of the first table member, first flap member and second table member form a generally continuous horizontal surface, and moving a first positioning member such that it spans between at least the first flap member and second table member to maintain the first flap member in the deployed position.

In a preferred embodiment, the abutting end surface of the first flap member and the second side surface of the second table member include supplementary angles with respect to the generally continuous horizontal surface. Preferably, the positioning member is affixed to the bottom surface of the second table member and the first table assembly includes a flap securing assembly that maintains the first flap member in the stowed position. The method further includes the step of disengaging the first flap member from the bottom surface of the first table member before pivoting the first flap member from the stowed position to a deployed position. Preferably, the flap securing assembly includes a complementary bearing assembly secured to one of the bottom surface of the first table member or the bottom surface of the first flap member and a ramp assembly secured to the other of the bottom surface of the first table member or the bottom surface of the first flap member.

In a preferred embodiment, the second table assembly includes a second flap member hingedly connected to the second table member. The second flap member has an abutting end surface, a hinge side surface, a top surface and a bottom surface and is in a stowed position such that the bottom surface of the second flap member is adjacent the bottom surface of the second table member. The method further includes providing a third table assembly that includes a horizontally oriented third table member with a top and bottom surface and having at least a third upright member extending downwardly therefrom that is secured to the floor. The method includes pivoting the second flap member from the stowed position to a deployed position such that the abutting end surface of the second flap member abuts the second side surface of the third table member so that the top surfaces of the first table member, first flap member, second table, second flap member and third table member form a generally continuous horizontal surface. The method also includes moving a second positioning member such that it spans between at least the second flap member and third table member to maintain the second flap member in the deployed position.

In accordance with yet another aspect of the present invention, there is provided a table assembly that includes a horizontally oriented table member having at least a first upright member extending downwardly therefrom, and first and second opposing side surfaces, third and fourth opposing side surfaces, a top surface and a bottom surface. The table assembly also includes a flap member having a top surface and a bottom surface hingedly connected to the first side surface of the table member. The flap member is movable between a stowed position where the bottom surface of the flap member abuts the bottom surface of the table member and a deployed position where the top surface of the flap member and the top surface of the table member form a generally continuous horizontal surface. The table assembly also includes a first flap securing assembly that secures the flap member to the bottom surface of the table member when the flap member is in the stowed position, and a first movable positioning member secured to the bottom surface of the table member. The first movable positioning member is movable between a stowed position and a deployed position. In the deployed position, at least a portion of the first positioning member extends horizontally outwardly beyond the second side surface of the table member.

In a preferred embodiment, the flap member includes an abutting end surface that forms a first non-right angle with the top surface of flap member and the second side surface of the table member forms a second non-right angle with the top surface of the table member. When the flap member is in the deployed position, the first non-right angle and second non-right angle are supplementary with respect to the generally continuous horizontal surface. Preferably, the table assembly also includes a second movable positioning member secured to the bottom surface of the table member that is movable between a stowed position and a deployed position. In the deployed position, the second positioning member extends horizontally outwardly beyond the second side surface of the table member.

The invention, together with additional features and advantages thereof, may be best understood by reference to the following description.

BRIEF DESCRIPTION OF THE DRAWINGS

The invention may be more readily understood by referring to the accompanying drawings in which.

Like numerals refer to like parts throughout the several views of the drawings.

DETAILED DESCRIPTION OF THE PREFERRED EMBODIMENTS

Figure 1:
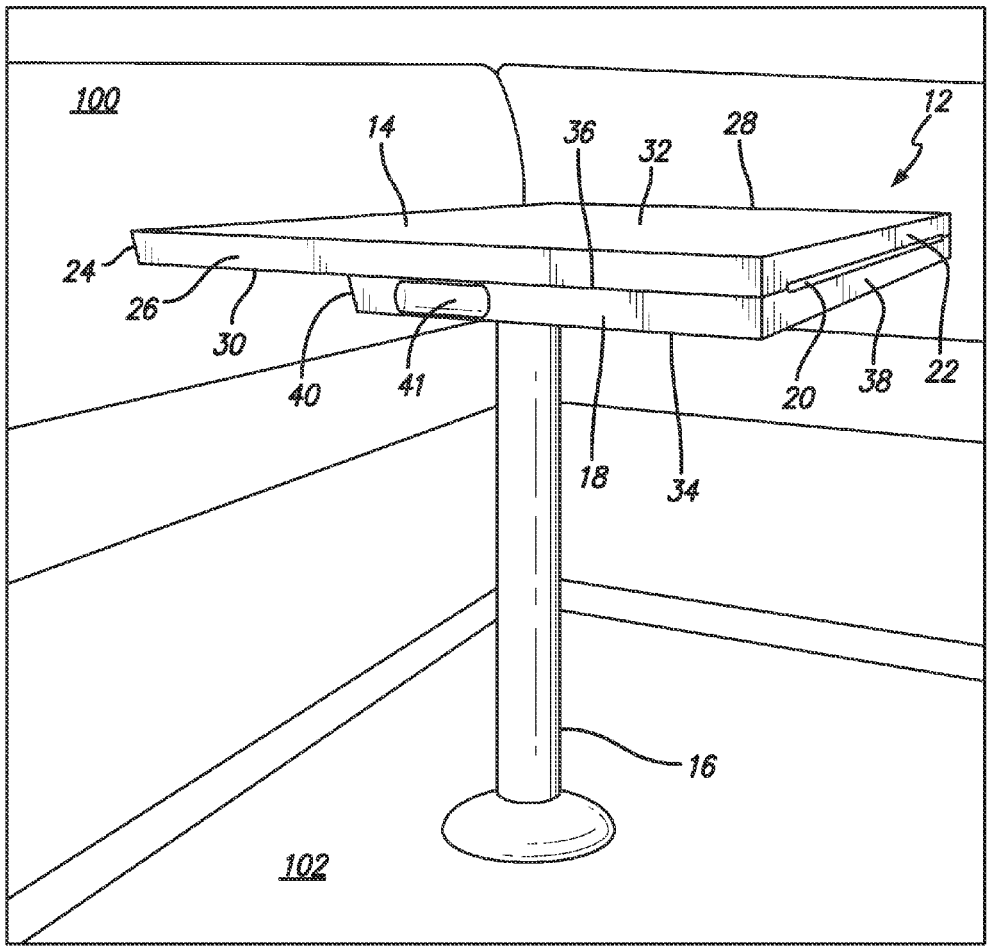
FIG. 1 is a perspective view of a table assembly in accordance with a preferred embodiment of the present invention.

The following description and drawings are illustrative and are not to be construed as limiting. Numerous specific details are described to provide a thorough understanding of the disclosure. However, in certain instances, well-known or conventional details are not described in order to avoid obscuring the description. References to one or an other embodiment in the present disclosure can be, but not necessarily are, references to the same embodiment; and, such references mean at least one of the embodiments.

Reference in this specification to "one embodiment" or "an embodiment" means that a particular feature, structure, or characteristic described in connection with the embodiment is included in at least one embodiment of the disclosure. Appearances of the phrase "in one embodiment" in various places in the specification do not necessarily refer to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

The terms used in this specification generally have their ordinary meanings in the art, within the context of the disclosure, and in the specific context where each term is used. Certain terms that are used to describe the disclosure are discussed below, or elsewhere in the specification, to provide additional guidance to the practitioner regarding the description of the disclosure. For convenience, certain terms may be highlighted, for example using italics and/or quotation marks: The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein. Nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

Without intent to further limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, all technical and scientific terms used herein have the same meaning as commonly understood by one of ordinary skill in the art to which this disclosure pertains. In the case of conflict, the present document, including definitions, will control.

It will be appreciated that terms such as "front," "back," "top," "bottom," "side," "short," "long," "up," "down," and "below" used herein are merely for ease of description and refer to the orientation of the components as shown in the figures. It should be understood that any orientation of the components described herein is within the scope of the present invention.

Referring now to the drawings, which are for purposes of illustrating the present invention and not for purposes of limiting the same, FIGS. 1-8 show a table system 10 that generally includes at least two table assemblies 12 positioned adjacent one another. In a preferred embodiment, the table system 10 is positioned or installed within a restaurant. For example, FIG. 1 shows a table assembly 12 positioned adjacent a corner booth 100. However, this is not a limitation on the present invention. The table system 10 can be installed in any location desired.

Generally, each table assembly 12 includes a horizontally oriented table member 14 that has at least one upright member 16 extending downwardly therefrom, and a flap member 18 hingedly/pivotably connected to the table member 14. FIG. 1 shows a hinge 20. However, any method of pivotably connecting the table member 14 and the flap member 18 is within the scope of the present invention. The table member 14 includes a first side surface 22, a second side surface 24, a third side surface 26, a fourth side surface 28, a bottom surface 30 and a top surface 32. The first and second side surfaces 22 and 24 oppose one another and the third and fourth side surfaces 26 and 28 oppose one another. The flap member 18 includes a top surface 34, a bottom surface 36, a hinge end surface 38 and an abutting end surface 40. As shown in FIG. 1, the hinge end surface 38 of the flap member 18 is hingedly connected to the first side surface 22 of the table member 14.

Figure 5:
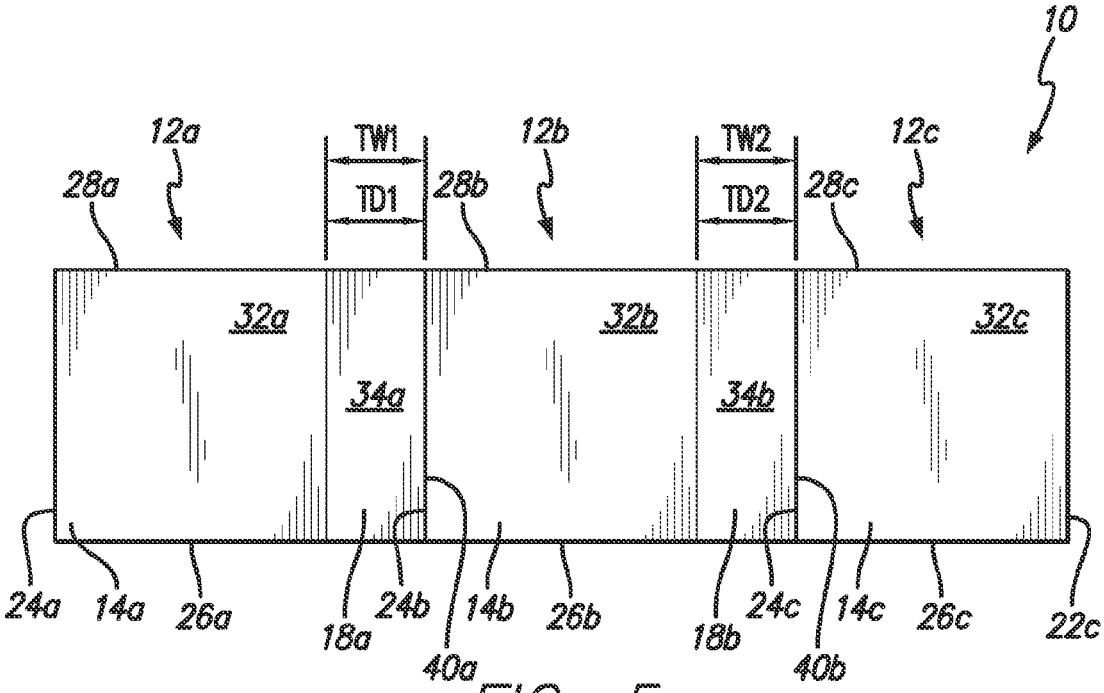
FIG. 5 is a top plan view of the table system of FIG. 4 showing the flap members in the deployed position.
Figure 6:
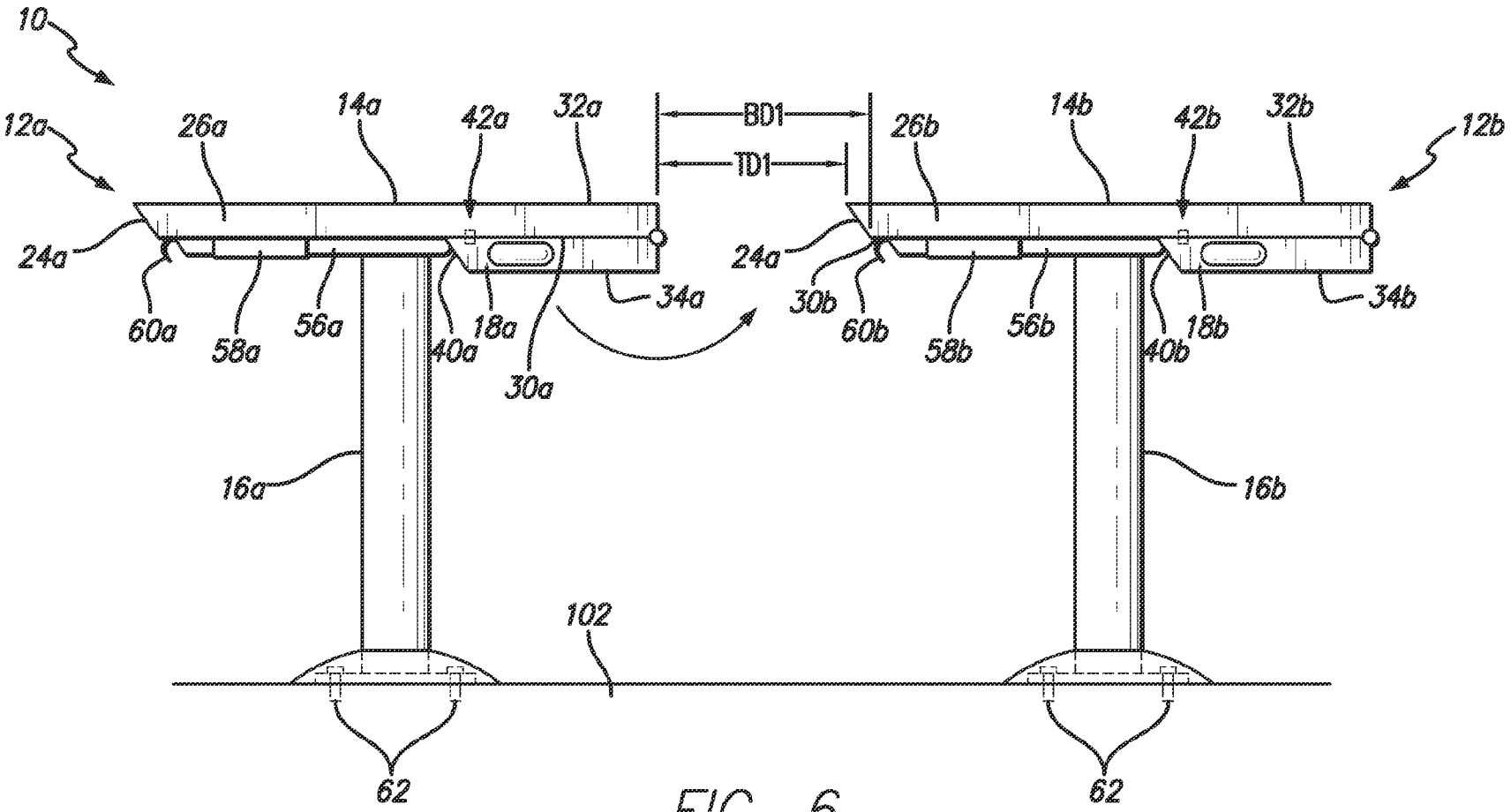
FIG. 6 is side elevational view of the table system of FIG. 4 showing the flap members in the stowed position.
Figure 7:
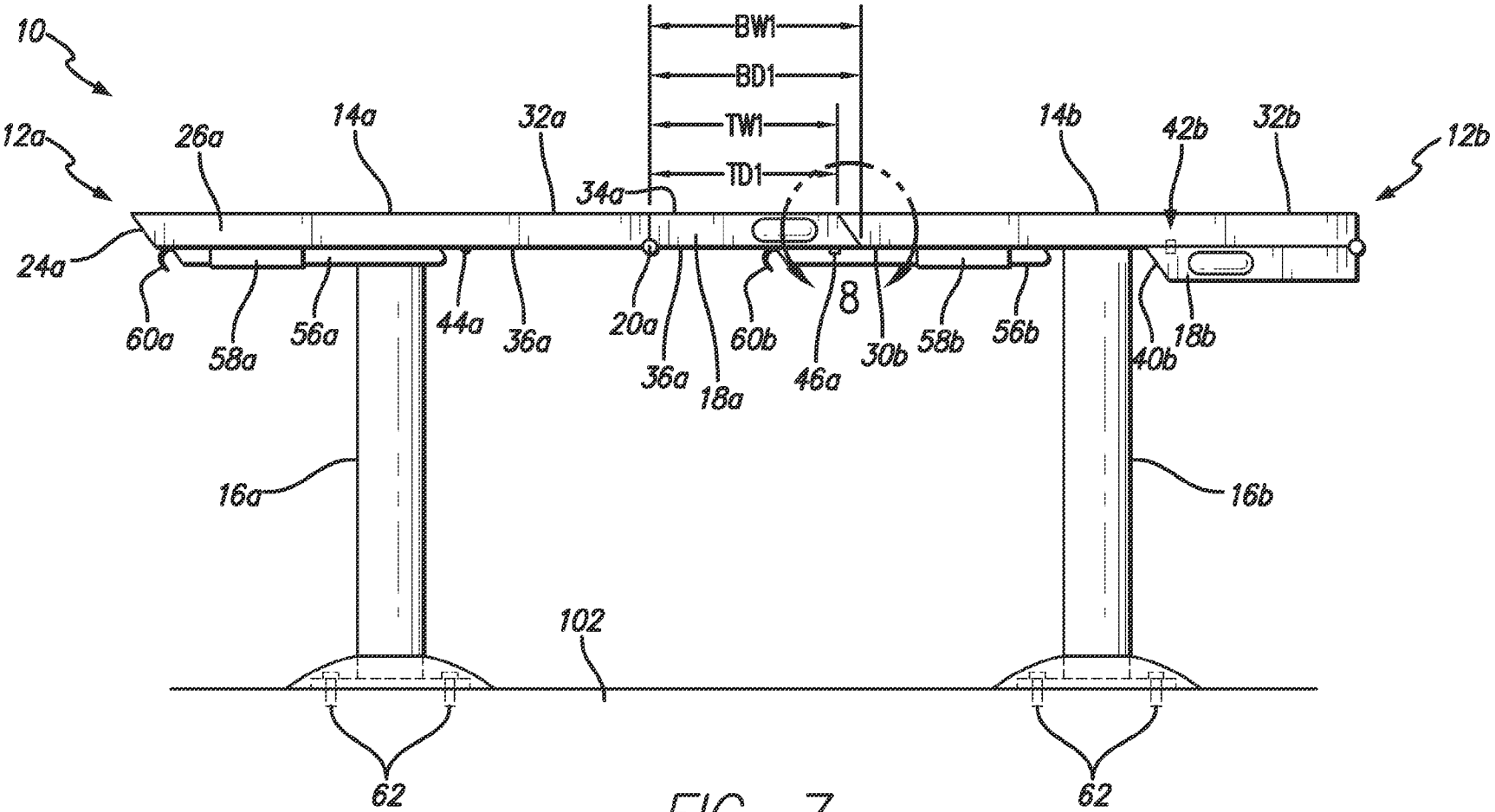
FIG. 7 is side elevational view of the table system of FIG. 4 showing the flap members in the deployed position.

In a preferred embodiment, the flap member 18 is movable between a stowed position where the bottom surface 36 of the flap member 18 abuts the bottom surface 30 of the table member 14 (see FIGS. 1 and 6) and a deployed position where the top surface 34 of the flap member 18 and the top surface 32 of the table member 14 form a generally continuous horizontal surface (see FIGS. 5 and 7). In a preferred embodiment, the flap member 18 includes a handle indentation 41 or the like to help move the flap member 18. In another embodiment, the handle can protrude outwardly. In another embodiment, the handle or handle indentation can be omitted. Preferably, the table assembly 12 includes a flap securing assembly 42 that secures the flap member 18 to the table member 14 when the flap member 18 is in the stowed position.

Figure 2:
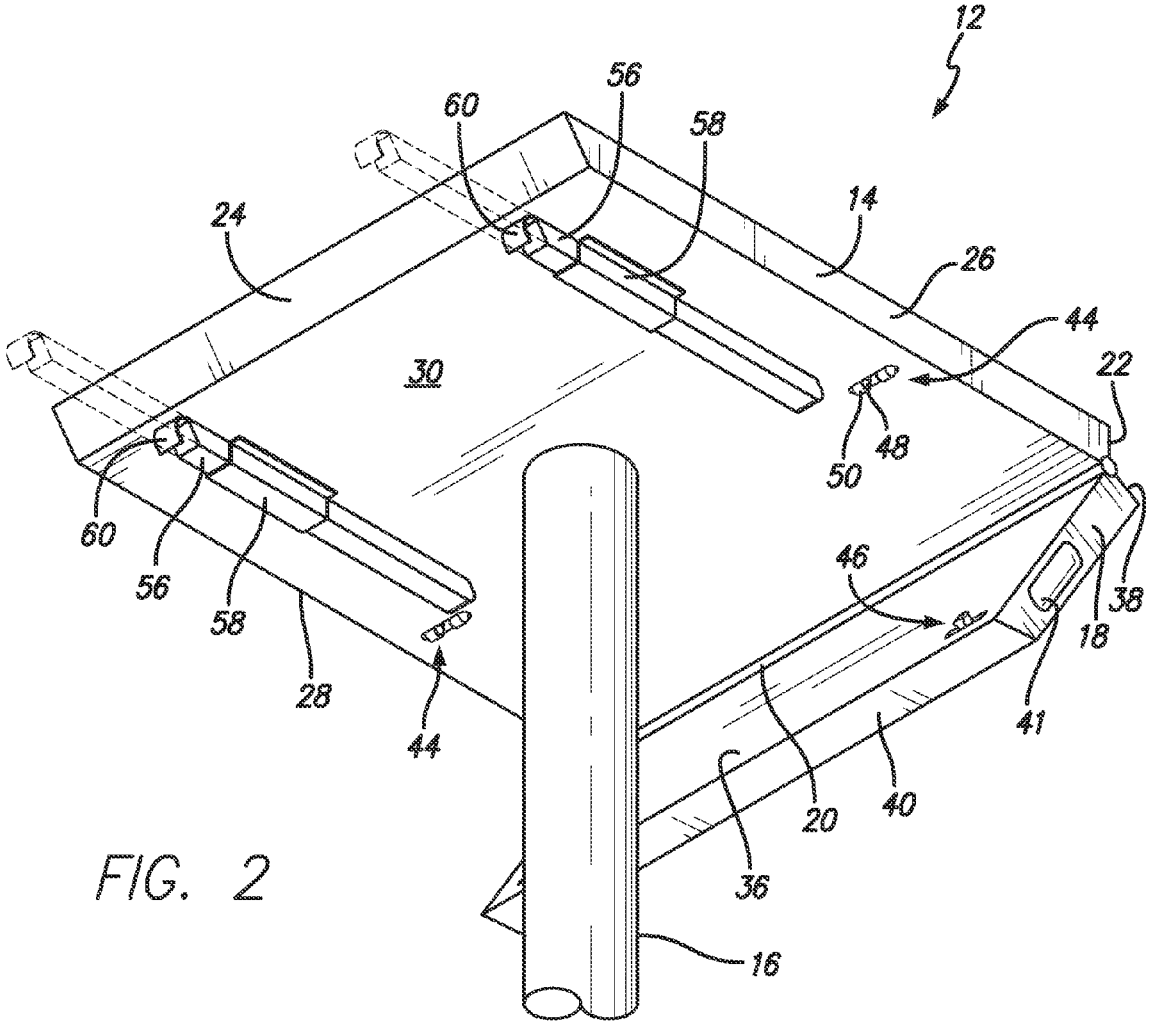
FIG. 2 is a perspective view of the underside of the table assembly of FIG. 1.
Figure 3:
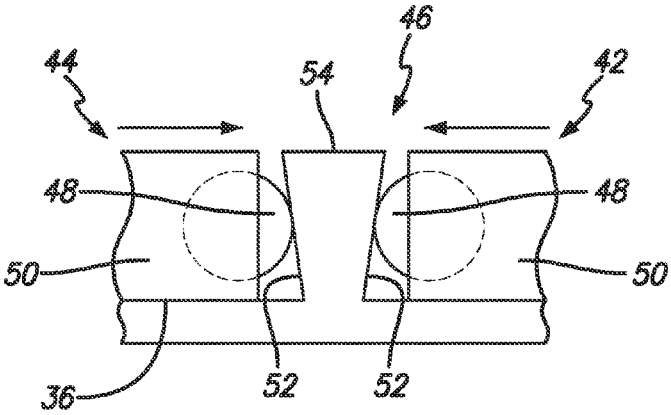
FIG. 3 is a detailed view of the flap securing assembly of the table assembly of FIG. 1.

As shown in FIGS. 2-3, in a preferred embodiment, the flap securing assembly 42 includes a complementary bearing assembly 44 affixed to the bottom surface 30 of the table member 14 and ramp assembly 46 affixed to the bottom surface 36 of the flap member 18. As is best shown in FIG. 3, the bearing assembly 44 includes opposing ball bearings 48 that extend partially outside of housings 50 and are biased toward one another (via springs or the like—see the arrows) and are spaced apart from one another. The ramp assembly 46 includes opposing inclined bearing surfaces 52 that bear against the ball bearings 48, and, as a result of the biasing force against the ball bearings 48, hold the ramp assembly 46 in place (and, therefore, the flap member 18 in the stowed position). It will be appreciated that when the ramp assembly 46 is pushed upwardly, the upper surface 54 of the ramp assembly 46, which is wider than the space between the ball bearings 48 when they are in the normal position, pushes the ball bearings 48 outwardly so that the ramp assembly 46 can be positioned properly (as shown in FIG. 3). Two release the flap member 18 a user pulls the flap member 18 downwardly with enough force to overcome the biasing force provided by the springs biasing the ball bearings 48. In a preferred embodiment, the flap member 18 includes two flap securing assemblies 42. However, any number can be provided.

Any type of flap securing assembly 42 that secures the flap member 18 to the table member 14 is within the scope of the present invention. For example, the flap securing assembly 42 may comprise, magnets, straps, buttons, snaps, clasps, zippers, pivotable members or the like.

As shown in FIG. 2, in a preferred embodiment, the table assembly 12 includes at least one (and preferably two) positioning members 56 secured to the bottom surface 30 of the table member 14. Preferably, the positioning member 56 is secured in place by a bracket 58 that allows the positioning member to move axially (horizontally) between a stowed position and a deployed position (shown in hidden lines in FIG. 2). In a preferred embodiment, the positioning member 56 includes a handle 60 that makes it easier for a user to pull the positioning member 56 into the deployed position.

In the deployed position, at least a portion of the positioning member 56 extends horizontally outwardly beyond the second side surface 24 of the table member 14. It will be appreciated that the positioning member 56 holds or maintains in place the flap member 18 of an adjacent table assembly 12, as more fully described below. In another embodiment, the positioning member(s) can move axially in the opposite direction of that shown in FIG. 2. In this embodiment, in the deployed position, the positioning members span between the table member 14 and the flap member 18 on the same table assembly 12 or the positioning members span between the table member 14 and the flap member 18 on the same table assembly 12 and across to the table member 14 of an adjacent table assembly 12.

Any type of positioning member that holds an adjacent flap member 18 in the deployed position is within the scope of the present invention. For example, a rod or post that rotates or pivots within a horizontal plane is within the scope of the present invention. Pegs, posts, fasteners, or other types of positioning members can also be used.

As shown in the figures, in a preferred embodiment, each table assembly 12 within the table system 10 includes angled ends that abut one another (see FIG. 7). Angled essentially means that the surfaces are not vertically oriented. More specifically, in a preferred embodiment, the abutting end surface 40 forms a first non-right angle A1 with the top surface 34 of the flap member 18 and the second side surface 24 forms a second non-right angle A2 with the top surface 32 of the table member 14. In a preferred embodiment, the first and second non-right angles are supplementary, which allows the abutting end surface 40 to abut the second side surface 24 of an adjacent table member 14, as more fully described below. As used herein, other than its ordinary meaning, "abuts" also includes two surface almost touching. In other words, a small gap is within the scope of the term.

With reference to FIGS. 4-8, a table system that includes at least two table assemblies 12 will now be described. FIGS. 4-5 and 6-7, show two and three table assemblies 12, respectively. It will be understood that any number of table assemblies 12 is within the scope of the present invention. Furthermore, for descriptive purposes only, the table members 14 are sized to seat two people each when the flap member 18 is in the stowed position. However, this is not a limitation on the present invention, and any sized table member 14 for any number of patrons is within the scope of the present invention.

Figure 4:
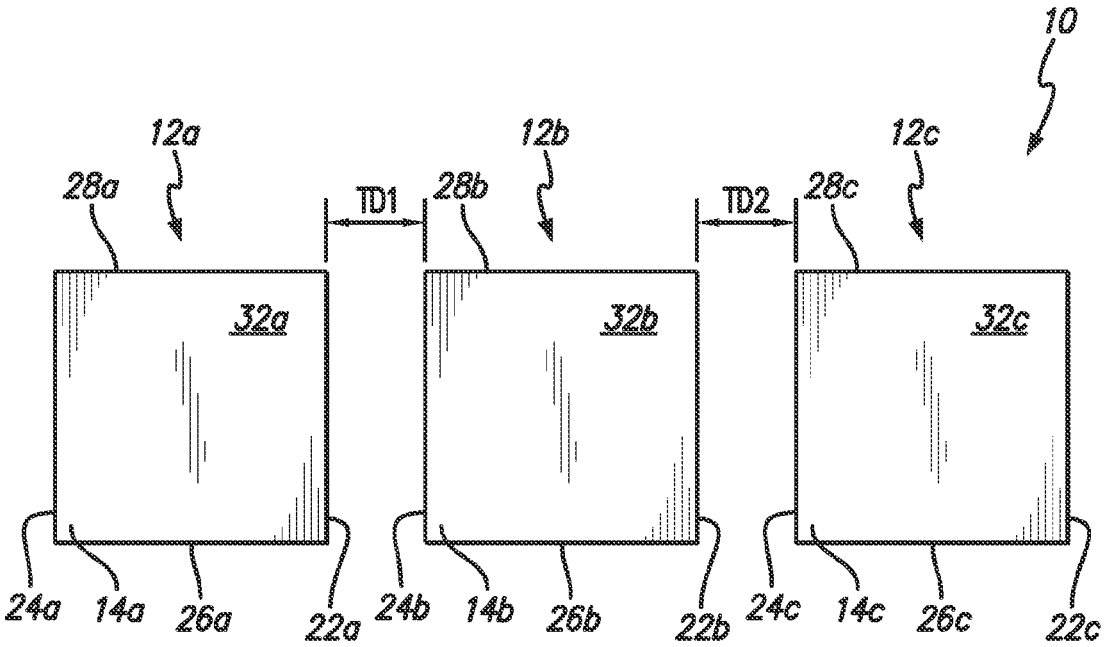
FIG. 4 is a top plan view of a table system in accordance with a preferred embodiment of the present invention and showing the flap members in the stowed position.

As shown in FIGS. 4 and 6, when the flap members 18 and positioning members 56 are in the stowed positions, a gap is defined between adjacent table assemblies 12. This configuration is used when each of the tables are being used as two tops. However, as shown in FIGS. 5 and 7 when the flap member(s) 18 and positioning members 56 are moved to the deployed positions, the flap member(s) 18 span the gap between tables and provide a continuous horizontal surface (i.e., a larger table) that can be used by a group, but within the same floor space as the two tops.

In a preferred embodiment, the upright members 16 are secured to the floor so that the gap between table assemblies 12 is unchangeable. In a more preferred embodiment, the upright members 16 are secured or fixed to the floor 102 by at least two and preferably four bolts 62 or other fasteners so that the upright member 16 (and, therefore, the table member 14) cannot rotate.

For ease of description, hereinbelow the first table assembly and all components thereof may be designated with an "a" in the description and drawings, the second table assembly and all components thereof may be designated with a "b" in the description and drawings, and the third table assembly and all components thereof may be designated with a "c" in the description and drawings.

Generally, the table system 10 includes first and second table assemblies 12*a* and 12*b*, that each have a table member 14*a* and 14*b* and a flap member 18*a* and 18*b*. In a preferred embodiment, a first top surface horizontal distance TD1 is defined between the top surface 32*a* of the first table member 14*a* and the top surface 32*b* of the second table 14*b* member. The top surface 34*a* of the first flap member 18*a* defines a first top surface width TW1 dimension. As shown in FIGS. 6-7, the first top surface horizontal distance TD1 and the first top surface width dimension TW1 are approximately the same. This allows the abutting end surface 40*a* of the first flap member 18*a* to abut the second side surface 24*b* of the second table member 14*b*. In other words, in the deployed position, the first flap member 18*a* spans the first top surface horizontal distance TD1 such that the top surface 32*a* of the first table member 14*a*, first flap member 18*a* and second table member 14*b* form a generally continuous surface. This configuration is relevant whether the first abutting end surface 40*a* and second side surface 24*b* of the second table member 14*b* are angled (as described above) or whether they are vertically oriented.

As described above, in a preferred embodiment, the abutting end surface 40 and second side surface 24 include supplementary angles so that a portion of the flap member 18 is positioned under a portion of the table member 14. This provides some stability between the table assemblies at the area where they overlap. In this embodiment, as shown in FIG. 7, a first bottom surface horizontal distance BD1 is defined between the bottom surface 30*a* of the first table member 14*a* and the bottom surface 30*b* of the second table 14*b* member. The bottom surface 36*a* of the first flap 18*a* defines a first bottom surface BW1 width dimension. In a preferred embodiment, the first bottom surface horizontal distance BD1 and the first bottom surface width dimension BW1 are approximately the same. However, due to the angled surfaces, the first bottom surface width dimension BW1 is greater than the first top surface width dimension TW1, and the first bottom surface horizontal distance BD1 is greater than the first top surface horizontal distance TD1. It will be understood that with these configurations, the abutting end surface and second side surface can have other matching shapes, such as curved or including multiple angled surfaces. The top surface 34*b* of the second flap member 18*b* defines a second top surface width dimension TW2. In a preferred embodiment, the first top surface width dimension TW1 and the second top surface width dimension TW2 (and the top surface width dimension of the flap members of other table assemblies) are approximately the same. This provides for uniformity throughout the system. However, this is not a limitation and in certain situations, the distance between table members and size of the flap members map be different.

It will be appreciated by those of ordinary skill in the art that the figures show each table assembly 12 with all components described above. However, it is contemplated that within a table system 10, the end table assemblies can omit unnecessary components. For example, in FIG. 6, second flap member 18*b* and first positioning member 56*a* can be omitted. It will further be appreciated that all tables assemblies 12 within a system 10 preferably have the same dimensions. However, this is not a limitation and the dimensions can change from table assembly 12 to table assembly 12.

With reference to FIGS. 6 and 7, in use, first flap member 18*a* is pivoted from the stowed position (FIG. 6) to the deployed position (FIG. 7). To secure and maintain the first flap member 18*a* in the stowed position, the user converting the table system grasps the second positioning member 56*b* (by handle 60*a*) and moves second positioning member 56*b* from the stowed position (FIG. 6) to the deployed position (FIG. 7). If two or more positioning members are present, this is done with all of them. Second positioning member 56*b* in the deployed position supports first flap member 18*a* in the deployed position.

Figure 8:
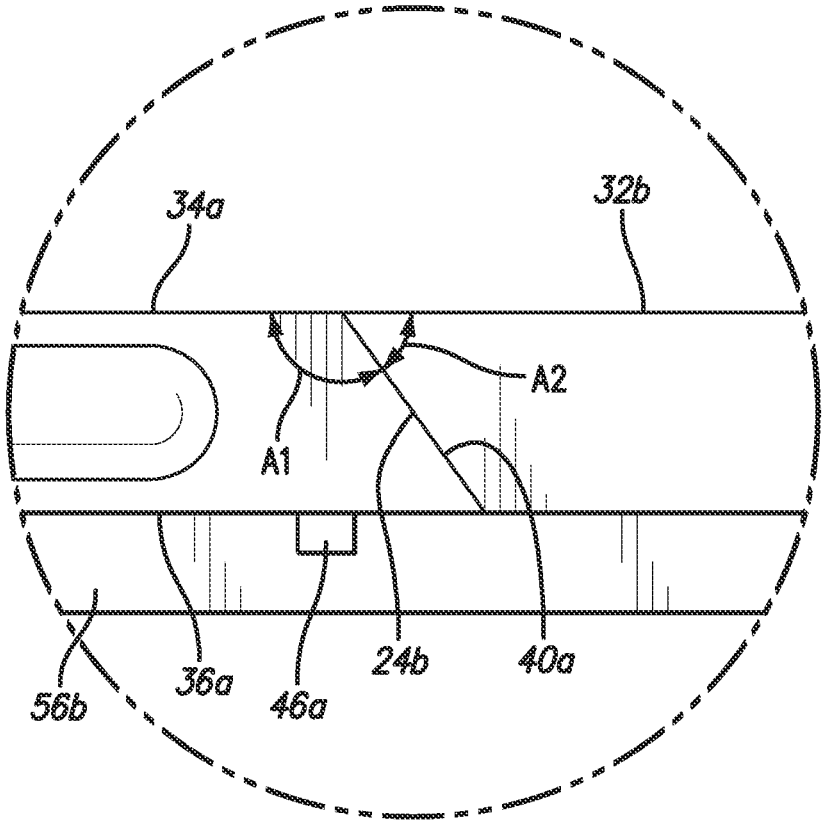
FIG. 8 is a detailed view showing the abutting end surface of the first table assembly and the second side surface of the adjacent second table assembly.

As shown in FIG. 8, in a preferred embodiment, the first abutting end surface 40*a* of first flap member 18*a* forms first non-right angle A1 with the top surface 34*a* of the first flap member 18*a* and the second side surface 24*b* of the second table member 14*b* forms second non-right angle A2 with the second top surface 32*b* of the second table member 14*b*. In a preferred embodiment, the first and second non-right angles are supplementary with respect to the generally horizontal continuous surface formed by the top surfaces 34*a* and 32*b* (and with respect to the floor). This allows the abutting end surface 40*a* to be generally flush with the second side surface 24*b* of the second table member 14*b*.

In use, to convert the table system 10 from a plurality of two tops to a larger table, a user pivots the first flap member 18*a* from the stowed position to the deployed position so that the abutting end surface 40*a* of the first flap member 18*a* abuts the second side surface 24*b* of the second table member 14*b*. In order to do this, the user must disengage the first flap securing assembly 42*a*. At this point, the top surfaces of the first table member 14*a*, first flap member 18*a* and second table member 14*b* form a generally continuous horizontal surface. Then, the user moves or pulls the second positioning member(s) 56*b* to the deployed position such that they span between the first flap member 18*a* and second table member 14*b* to maintain the first flap member 18*a* in the deployed position. Moreover, the positioning member 56 can be configured as desired to span between the first flap member 18*a* and second table member 14*b*, but can be affixed to either.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description of the Preferred Embodiments using the singular or plural number may also include the plural or singular number respectively. The word "or" in reference to a list of two or more items, covers all of the following interpretations of the word: any of the items in the list, all of the items in the list, and any combination of the items in the list.

The above-detailed description of embodiments of the disclosure is not intended to be exhaustive or to limit the teachings to the precise form disclosed above. While specific embodiments of and examples for the disclosure are described above for illustrative purposes, various equivalent modifications are possible within the scope of the disclosure, as those skilled in the relevant art will recognize. For example, while processes or blocks are presented in a given order, alternative embodiments may perform routines having steps, or employ systems having blocks, in a different order, and some processes or blocks may be deleted, moved, added, subdivided, combined, and/or modified to provide alternative or subcombinations. Each of these processes or blocks may be implemented in a variety of different ways. Also, while processes or blocks are at times shown as being performed in series, these processes or blocks may instead be performed in parallel, or may be performed, at different times. Further any specific numbers noted herein are only examples: alternative implementations may employ differing values or ranges.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference in their entirety. Aspects of the disclosure can be modified, if necessary, to employ the systems, functions, and concepts of the various references described above to provide yet further embodiments of the disclosure.

These and other changes can be made to the disclosure in light of the above Detailed Description of the Preferred Embodiments. While the above description describes certain embodiments of the disclosure, and describes the best mode contemplated, no matter how detailed the above appears in text, the teachings can be practiced in many ways. Details of the system may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features or aspects of the disclosure with which that terminology is associated. In general, the terms used in the following claims should not be construed to limit the disclosures to the specific embodiments disclosed in the specification unless the above Detailed Description of the Preferred Embodiments section explicitly defines such terms. Accordingly, the actual scope of the disclosure encompasses not only the disclosed embodiments, but also all equivalent ways of practicing or implementing the disclosure under the claims.

While certain aspects of the disclosure are presented below in certain claim forms, the inventors contemplate the various aspects of the disclosure in any number of claim forms. For example, while only one aspect of the disclosure is recited as a means-plus-function claim under 35 U.S.C. §112, ¶6, other aspects may likewise be embodied as a means-plus-function claim, or in other forms, such as being embodied in a computer-readable medium. (Any claims intended to be treated under 35 U.S.C. §112, ¶6 will begin with the words "means for"). Accordingly, the applicant reserves the right to add additional claims after filing the application to pursue such additional claim forms for other aspects of the disclosure.

Accordingly, although exemplary embodiments of the invention have been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A table system that is adapted to be affixed to a floor, the table system comprising:

at least first and second table assemblies, the first table assembly including a horizontally oriented first table member having at least a first upright member extending downwardly therefrom, wherein the first upright member is adapted to be secured to the floor, and wherein the first table member has a top surface and a bottom surface, a first flap member hingedly connected to the first table member and movable between a stowed position and a deployed position, wherein the first flap member has a top surface and a bottom surface, the second table assembly including a horizontally oriented second table member having at least a second upright member extending downwardly therefrom, wherein the second upright member is adapted to be secured to the floor, and wherein the second table member has a top surface and a bottom surface, wherein a first top surface horizontal distance is defined between the top surface of the first table member and the top surface of the second table member, wherein the top surface of the first flap member defines a first top surface width dimension, and wherein the first top surface horizontal distance and the first top surface width dimension are approximately the same, whereby in the deployed position, the first flap member spans the first top surface horizontal distance such that the top surface of the first table member, first flap member and second table member form a generally continuous surface.

2. The table system of claim 1 wherein a first bottom surface horizontal distance is defined between the bottom surface of the first table member and the bottom surface of the second table member, wherein the bottom surface of the first flap member defines a first bottom surface width dimension, and wherein the first bottom surface horizontal distance and the first bottom surface width dimension are approximately the same, wherein the first bottom surface width dimension is greater than the first top surface width dimension, and wherein the first bottom surface horizontal distance is greater than the first top surface horizontal distance.

3. The table system of claim 2 wherein the second table assembly includes a second flap member hingedly connected to the second table member and movable between a stowed position and a deployed position, wherein the second flap member has a top surface and a bottom surface, wherein the top surface of the second flap member defines a second top surface width dimension, and wherein the first top surface width dimension and the second top surface width dimension are approximately the same.

4. The table system of claim 1 wherein the second table member includes at least one movable positioning member affixed to the bottom surface thereof, wherein the positioning member is movable between a stowed position and a deployed position, and wherein in the deployed position, the positioning member maintains the first flap member in the deployed position.

5. The table system of claim 4 wherein the first table assembly includes a flap securing assembly that maintains the first flap member in the stowed position.

6. A method performed in a restaurant having a floor, the method comprising the steps of:

providing a first table assembly that includes a horizontally oriented first table member having at least a first upright member extending downwardly therefrom that is secured to the floor, and wherein the first table member has first and second opposing side surfaces, third and fourth opposing side surfaces, a top surface and a bottom surface, and a first flap member hingedly connected to the first table member, wherein the first flap member has an abutting end surface, a hinge side surface, a top surface and a bottom surface, wherein the first flap member is in a stowed position such that the bottom surface of the first flap member is adjacent the bottom surface of the first table member, providing a second table assembly that includes a horizontally oriented second table member having at least a second upright member extending downwardly therefrom that is secured to the floor, and wherein the second table member has a top surface and a bottom surface, pivoting the first flap member from the stowed position to a deployed position such that the abutting end surface of the first flap member abuts a second side surface of the second table member, whereby the top surfaces of the first table member, first flap member and second table member form a generally continuous horizontal surface, and moving a first positioning member such that it spans between at least the first flap member and second table member to maintain the first flap member in the deployed position.

7. The method of claim 6 wherein the abutting end surface of the first flap member and the second side surface of the second table member include supplementary angles with respect to the generally continuous horizontal surface.

8. The method of claim 6 wherein the positioning member is affixed to the bottom surface of the second table member.

9. The table system of claim 8 wherein the first table assembly includes a flap securing assembly that maintains the first flap member in the stowed position, and wherein the method further comprises the step of disengaging the first flap member from the bottom surface of the first table member before pivoting the first flap member from the stowed position to a deployed position.

10. The table system of claim 9 wherein the flap securing assembly includes a complementary bearing assembly secured to one of the bottom surface of the first table member or the bottom surface of the first flap member and a ramp assembly secured to the other of the bottom surface of the first table member or the bottom surface of the first flap member.

11. The table system of claim 6 wherein the second table assembly includes a second flap member hingedly connected to the second table member, wherein the second flap member has an abutting end surface, a hinge side surface, a top surface and a bottom surface, wherein the second flap member is in a stowed position such that the bottom surface of the second flap member is adjacent the bottom surface of the second table member, and wherein the method further comprising providing a third table assembly that includes a horizontally oriented third table member having at least a third upright member extending downwardly therefrom that is secured to the floor, and wherein the third table member has a top surface and a bottom surface, pivoting the second flap member from the stowed position to a deployed position such that the abutting end surface of the second flap member abuts a second side surface of the third table member, whereby the top surfaces of the first table member, first flap member, second table, second flap member and third table member form a generally continuous horizontal surface, and moving a second positioning member such that it spans between at least the second flap member and third table member to maintain the second flap member in the deployed position.

* * * * *